US007272238B2

(12) United States Patent
Kemmerer et al.

(10) Patent No.: US 7,272,238 B2
(45) Date of Patent: Sep. 18, 2007

(54) LOUDSPEAKER HAVING COOLING SYSTEM

(75) Inventors: Jason Kemmerer, Thousand Oaks, CA (US); Robert True, Pleasant Prairie, WI (US)

(73) Assignee: Alpine Electronics, Inc., Tokyo (JP)

( * ) Notice: Subject to any disclaimer, the term of this patent is extended or adjusted under 35 U.S.C. 154(b) by 342 days.

(21) Appl. No.: 10/963,152

(22) Filed: Oct. 12, 2004

(65) Prior Publication Data

US 2006/0078151 A1 Apr. 13, 2006

(51) Int. Cl.
*H04R 1/00* (2006.01)
*H04R 9/06* (2006.01)
*H04R 11/02* (2006.01)

(52) U.S. Cl. ..... 381/414; 381/297; 381/419

(58) Field of Classification Search ..... 381/397, 381/412, 420, 419, 164, 165, 396, 407, 414; 165/48.1; 335/222, 223
See application file for complete search history.

(56) References Cited

U.S. PATENT DOCUMENTS 5,357,586 A * 10/1994 Nordschow et al. ..... 381/397
5,815,587 A * 9/1998 Goller ..... 381/412
5,940,522 A * 8/1999 Cahill et al. ..... 381/397
6,373,957 B1 * 4/2002 Stewart ..... 381/397
6,535,613 B1 * 3/2003 Ssutu ..... 381/397
6,639,993 B2 * 10/2003 Kemmerer et al. ..... 381/397
6,678,387 B2 * 1/2004 Kemmerer ..... 381/397
6,751,334 B2 * 6/2004 Harkansson ..... 381/396
7,016,514 B2 * 3/2006 White et al. ..... 381/397

FOREIGN PATENT DOCUMENTS

JP 11-168797 6/1999

* cited by examiner

*Primary Examiner*—Sinh Tran
*Assistant Examiner*—Stephen C Hung
(74) *Attorney, Agent, or Firm*—Muramatsu & Associates

(57) ABSTRACT

A loudspeaker has a cooling system in which a pole piece has a shorting ring made of non-magnetic conductive material that stabilizes magnetic field to reduce distortion of sound and a heat dissipation plate that couples to the shorting ring to facilitate efficient dissipation of heat. The heat generated by a voice coil of the loudspeaker is transmitted to the shorting ring and is conducted to the heat dissipation plate which acts as a heat sink to allow the heat dissipation. A multiplicity of shorting rings may be provided to further reduce impedance modulation, each of which is coupled to the heat dissipation plate. The heat dissipation plate has a gap in an axial direction of the loudspeaker to prevent an electric current in the shorting ring from flowing through the heat dissipation plate.

19 Claims, 15 Drawing Sheets

LOUDSPEAKER HAVING COOLING SYSTEM

FIELD OF THE INVENTION

This invention relates to a loudspeaker having a cooling system, and more particularly, to a loudspeaker with a shorting ring and a heat dissipation plate thermally connected with each other for efficient heat dissipation while reducing distortion in sound by improving impedance characteristic of the loudspeaker.

BACKGROUND OF THE INVENTION

Loudspeakers, or speakers, are well known in the art and are commonly used in a variety of applications, such as in home theater stereo systems, car audio systems, indoor and outdoor concert halls, and the like. A loudspeaker typically includes an acoustic transducer comprised of an electromechanical device which converts an electrical signal into acoustical energy in the form of sound waves and an enclosure for directing the sound waves produced upon application of the electrical signal.

An example of structure in the conventional loudspeaker is shown in FIG. 1. The loudspeaker 11 includes a speaker cone 13 forming a diaphragm 17, a coil bobbin 25, and a dust cap 15. The diaphragm 17, the dust cap 15 and the coil bobbin 25 are attached to one another. The voice coil 27 is attached around the coil bobbin 25. The voice coil 27 is connected to suitable leads (not shown) to receive an electrical input signal through the electrical terminals.

The diaphragm 17 is provided with an upper half roll 21 at its peripheral made of flexible material. The diaphragm 17 connects to the speaker frame 19 at the upper half roll 21 by means of, for example, an adhesive. At about the middle of the speaker frame 19, the intersection of the diaphragm 17 and the coil bobbin 25 is connected to the speaker frame 19 through a spider (inner suspension) 23 made of a flexible material. The upper half roll 21 and the spider 23 allow the flexible vertical movements of the diaphragm 17 as well as limit or damp the amplitudes (movable distance in an axial direction) of the diaphragm 17 when it is vibrated in response to the electrical input signal.

An air gap 41 and annular members including a pole piece 37, a permanent magnet 33, and an upper (top) plate 35 make up a magnetic assembly. In this example, the pole piece 37 has a back plate 38 integrally formed at its bottom. The pole piece 37 has a central opening 40 formed by a pole portion 39 for dissipating heat generated by the voice coil 27. The permanent magnet 33 is disposed between the upper plate 35 and the back plate 38 of the pole piece 37. The upper plate 35 and the pole piece 37 are constructed from a material capable of carrying magnetic flux, such as steel. Therefore, a magnetic path is created through the pole piece 37, the upper plate 35, the permanent magnet 33 and the back plate 38 through which the magnetic flux runs.

The air gap 41 is created between the pole piece 37 and the upper plate 35 in which the voice coil 27 and the coil bobbin 25 are inserted in the manner shown in FIG. 1. Thus, when the electrical input signal is applied to the voice coil 27, the current flowing in the voice coil 27 and the magnetic flux (flux density) interact with one another. This interaction produces a force on the voice coil 27 which is proportional to the product of the current and the flux density. This force activates the reciprocal movement of the voice coil 27 on the coil bobbin 25, which vibrates the diaphragm 17, thereby producing the sound waves.

For a loudspeaker described above, heat within the loudspeaker and distortion of sound can be problematic. The voice coil is constructed of a conductive material having electrical resistance. As a consequence, when an electrical signal is supplied to the voice coil, the electric current flowing through the coil generates heat because of the interaction with the resistance. Therefore, the temperature within the loudspeaker and its enclosure will increase. A substantial portion of the electrical input power is converted into heat rather than into acoustic energy.

Such temperature rise in the voice coil creates various disadvantages. As an example of disadvantage, it has been found that significant temperature rise increases the resistance of the voice coil. This, in turn, results in a substantial portion of the input power of the loudspeaker to be converted to the heat, thereby lowering the efficiency and performance of the loudspeaker. In particular, it has been found that increased resistance of the voice coil in the loudspeaker can lead to non-linear loudness compression effects at high sound levels.

When additional power is supplied to compensate for the increased resistance, additional heat is produced, again causes an increase in the resistance of the voice coil. At some point, any additional power input will be converted mostly into heat rather than acoustic output. Further, significant temperature rise can melt bonding materials in the voice coil or overheat the voice coil, resulting in permanent structural damage to the loudspeaker.

Moreover, in the audio sound reproduction involving such a loudspeaker, it is required that the loudspeaker is capable of producing a high output power with low distortion in the sound waves. Low distortion translates to accurate reproduction of sound from the speaker. It is known in the art that a loudspeaker is more nonlinear and generates more distortion in lower frequencies which require large displacement of the diaphragm.

In order to solve this problem, it has been proposed to use a ring (cylinder) shaped conducting material (hereafter "shorting ring") around a pole piece. The shorting ring stabilizes the magnetic field against changes caused by the current in the voice coil. The shoring ring acts as a short circuit winding that generates an inversely directed magnetic flux to counter the modulating effect of the voice coil on the flux in the permanent magnetic field. However, this arrangement does not, by itself, provide an efficient cooling mechanism. Thus, there is a demand for a loudspeaker that can dissipate heat efficiently while minimizing distortion of sound at the same time.

SUMMARY OF THE INVENTION

It is, therefore, an object of the present invention to provide a loudspeaker having an improved cooling system while minimizing distortions of sound.

It is another object of the present invention to provide a loudspeaker having a shorting ring coupled with a heat dissipation plate, thereby stabilizing magnetic field and efficiently dissipating heat.

It is a further object of the present invention to provide a method and structure for assembling the cooling system having the shorting ring and the heat dissipation plate in the loudspeaker.

One aspect of the present invention is a loudspeaker with high heat dissipation efficiency and low sound distortion. The loudspeaker is comprised of a speaker frame, a diaphragm connected to the speaker frame in a manner capable of vibration, a voice coil which is formed on a voice coil bobbin and is connected to the diaphragm for vibrating the diaphragm, a magnetic assembly including a permanent magnet, a pole piece disposed at a central opening of the magnet assembly to form an air gap between the magnetic assembly into which the voice coil is movably positioned, a heat dissipation plate mounted on the pole piece at an inner opening thereof, a shorting ring mounted on an outer surface of the pole piece.

The heat dissipation plate and the shorting ring are made of non-magnetic and thermally conductive material. Preferably, a steel ring is mounted on the outer surface of the pole piece to narrow the air gap so that magnetic flux generated by the permanent magnet will not significantly reduced in the air gap. Alternatively, the pole piece has a magnetic flange to form the narrow air gap between the magnetic assembly. The shorting ring stabilizes the magnetic flux without regard to the position of the voice coil, thereby increasing the sound quality of the loudspeaker.

The heat dissipation plate is coupled to the shorting ring and the vibration of the diaphragm produces air flows through the inner opening of the pole piece to intake cool air and exhaust heated air between the inside and outside of the loudspeaker. The heat generated by the loudspeaker can be efficiently dissipated via the heat dissipation plate that acts as a heat sink.

Preferably, the heat dissipation plate has a gap (cut) to suppress or eliminates flows of electric current in the heat dissipation plate, thereby maintaining the low distortion effect derived from the shorting ring. Preferably, a pair of shorting rings are used in the loudspeaker, one is an upper shorting ring mounted right above the steel ring (or magnetic flange) and the other is a lower shorting ring mounted right below the steel ring (or magnetic flange). The shorting rings, the pole piece, and the heat dissipation plate are thermally coupled to one another.

Another aspect of the present invention is a method of assembling the cooling system in a loudspeaker. The method is comprised of the steps of mounting a lower shorting ring on a pole piece, mounting a steel ring made of magnetic material on the pole piece right above the lower shorting ring, inserting a heat dissipation plate in slits of the pole piece, mounting an upper shorting ring on the pole piece right above the steel ring, and mounting the pole piece at a bottom center of a frame of the loudspeaker.

In the case where the pole piece has a magnetic flange integrally formed thereon, the method is comprised of the steps of mounting a lower shorting ring on a pole piece, mounting the pole piece on a back plate; inserting a heat dissipation plate in slits of the pole piece, mounting an upper shorting ring on the pole piece right above the steel ring, and mounting the pole piece and the back plate at a bottom center of a frame of the loudspeaker.

According to the present invention, in the loudspeaker, the cooling system can efficiently dissipate the heat through the shorting rings and the heat dissipation plate. The loudspeaker utilizing the cooling system of the present invention achieves a significant increase in the cooling efficiency while maintaining the low distortion effect based on the shorting rings. The cooling system of the present invention has a simple structure which is relatively easy to assemble, thereby decreasing the overall cost and production time of the loudspeaker.

DETAILED DESCRIPTION OF THE INVENTION

The loudspeaker of the present invention is provided with a shorting ring and a heat dissipation plate thermally connected with one another to establish a cooling system for dissipating heat generated by the loudspeaker. A shorting ring in a magnetic circuit has been proposed to improve an impedance characteristics of a loudspeaker. The cooling system of the present invention makes use of the shorting ring to improve the sound quality as well as to promote heat dissipation in combination with the heat dissipation plate. Because of the shorting ring and the heat dissipation plate, the loudspeaker of the present is able to efficiently dissipate the heat, and at the same time, to minimize distortion of the sound by compensating the impedance characteristic.

The effect and structure of the shorting ring is described, for example, in U.S. Pat. No. 5,815,587 and Japanese Patent Laid-Open Publication No. 11-168797. One of the main effect of the shorting ring is that the magnetic field is stabilized against changes caused by the current in the voice coil. Another main effect is that the current of the voice coil is coupled to an impedance which is largely independent of the position of the voice coil in the vertical (axial) direction of the air gap. Thus, the shorting ring promotes to achieve low distortion in a wide frequency range of the audible sounds.

Figure 1:
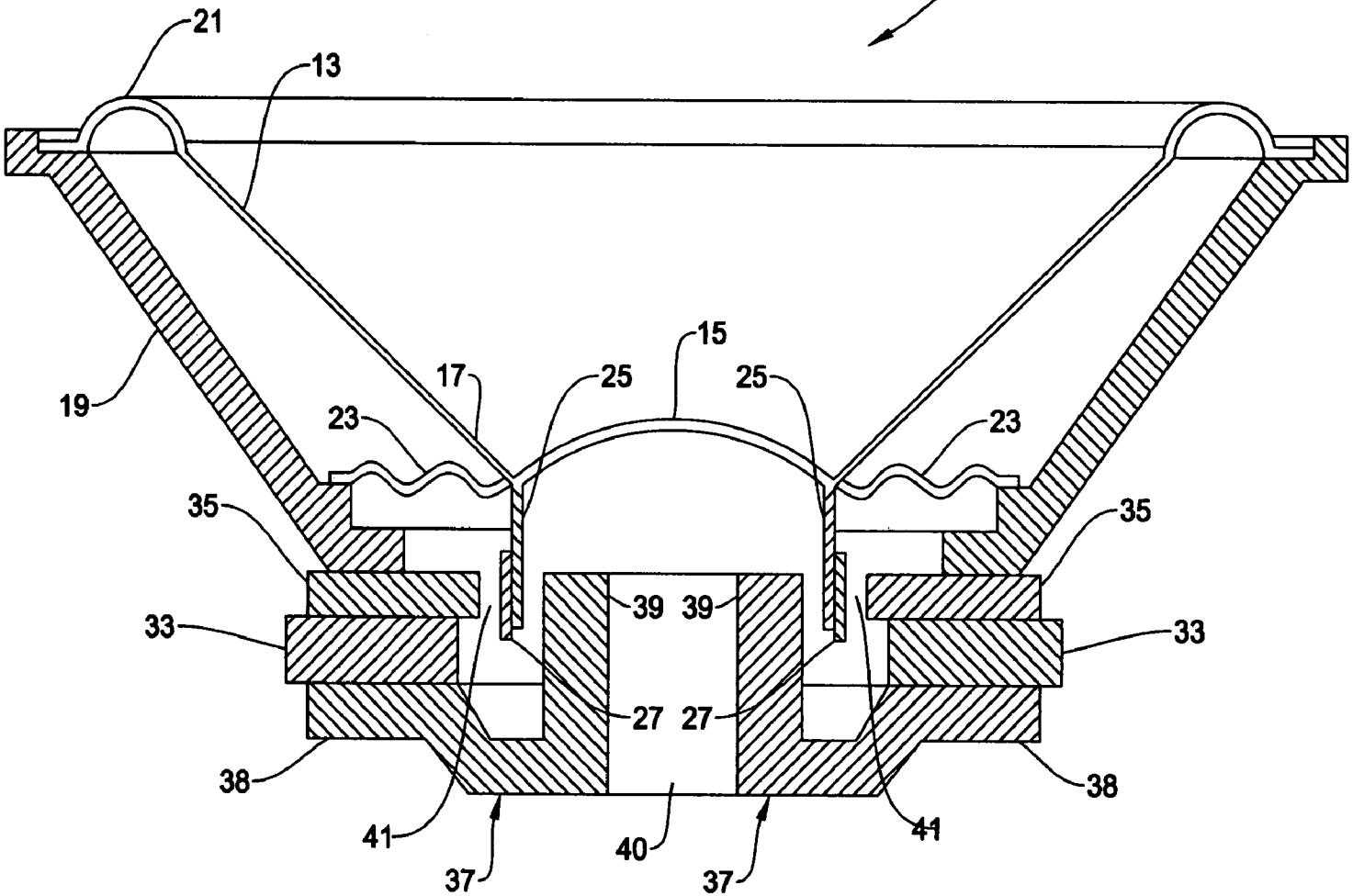
Fig. 1 (Prior Art)
FIG. 1 is a cross sectional view showing an example of inner structure of a loudspeaker in the conventional technology.
Figure 2:
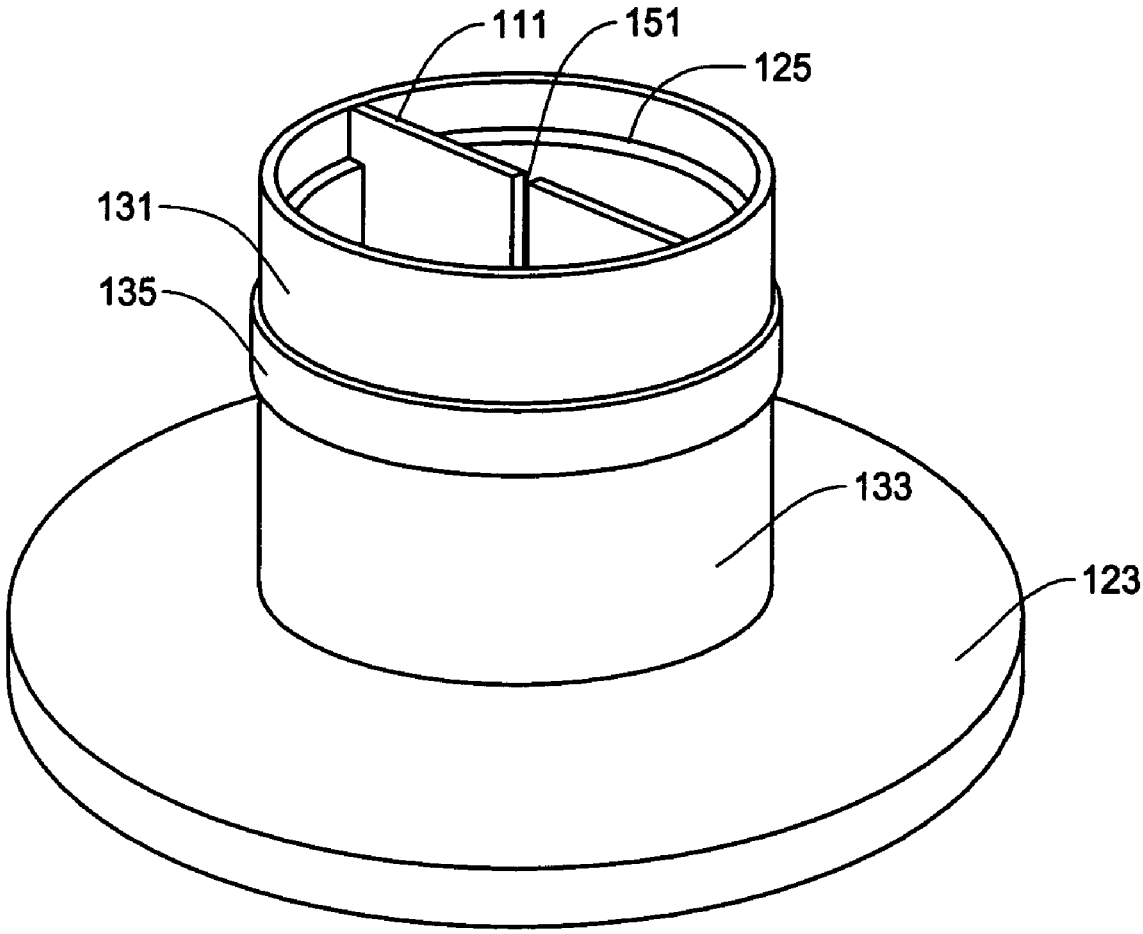
FIG. 2 is a perspective view showing a cooling system of the present invention having shorting rings, a heat dissipation plate, and a steel ring respectively mounted on a pole piece of the loudspeaker.

With reference to the perspective view of FIG. 2, the essential feature of the present invention is explained, which is directed to a cooling system formed of a shorting ring and a heat dissipation plate mounted on a pole piece of the loudspeaker. The cooling system of FIG. 2 roughly corresponds to the pole piece 37 in FIG. 1 described above when installed in a loudspeaker. This example includes two shorting rings on the pole piece for maximum effect although one shorting ring is also feasible.

More specifically, the cooling system of FIG. 2 includes a back plate 123 which forms a part of the magnetic circuit, an upper shorting ring 131, a lower shorting ring 133, a steel ring 135, and a heat dissipation plate 111. A pole piece 125 is integrally or separately formed on the back plate 123. The upper shorting ring 131, the lower shorting ring 133, and the steel ring 135 are mounted on the outer surface of the pole piece 125. The heat dissipation plate 111 is mounted inside, i.e., an inner opening of the pole piece 125 at about the center thereof.

The steel ring 135 has a magnetic property which can interact with a voice coil 58 (FIG. 7) to produce sound waves when an electric current is applied. The steel ring 135 is provided to maintain the air gap of the magnetic circuit as small enough even when the shorting rings are formed on the pole piece 125. The shorting rings 131 and 133 are made of electrically and thermally conductive material such as copper, nickel, and aluminum without magnetic property. The heat dissipation plate 111 is also made of thermally conductive non-magnetic material such as copper, nickel, and aluminum. In this example, a gap (cut) 151 is provided at the center of the heat dissipation plate 111 in a vertical (axial) direction to reduce the electric currents therethrough as will be explained later.

Figure 7:
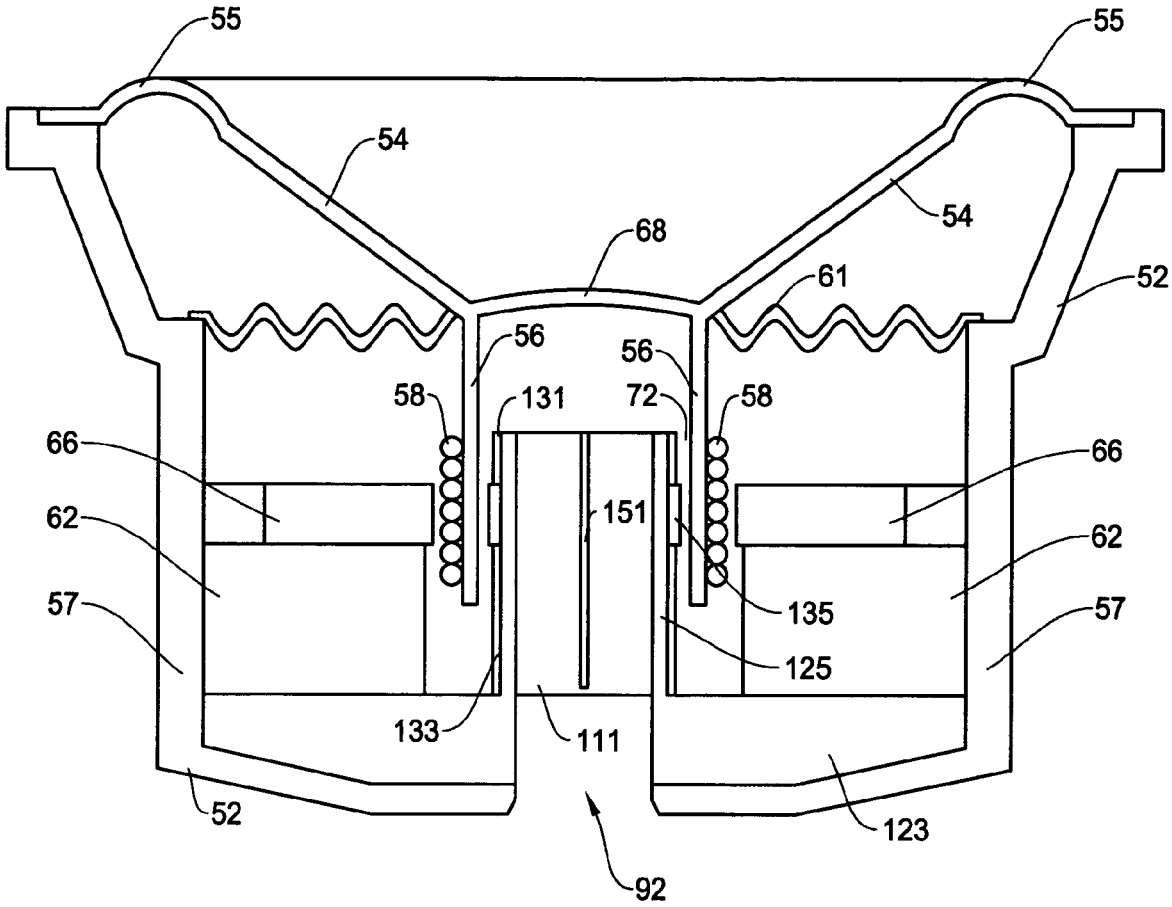
FIG. 7 is a cross sectional view showing an example of inner structure of the loudspeaker of the present invention incorporating the cooling system of FIGS. 2-4 which utilizes the shorting ring, the heat dissipation plate, and the steel ring.

The upper shorting ring 131 and the lower shorting ring 133 sandwich the steel ring 135 on the surface of the pole piece 125, to efficiently reduce the sound distortion. Preferably, the steel ring 135 has a thickness slightly larger than that of the shorting rings 131 and 133 so that the surface of the steel ring 135 is projected from the surface of the shorting rings 131 and 133. The shorting rings 131 and 133 should be as close as possible to the gap edge to maximize the heat transfer without causing interference with the voice coil travel tolerance in the air gap. Thus, the steel ring 135 forms the air gap of the magnetic circuit where the voice coil moves up/down in the air gap (FIG. 7).

Figure 3:
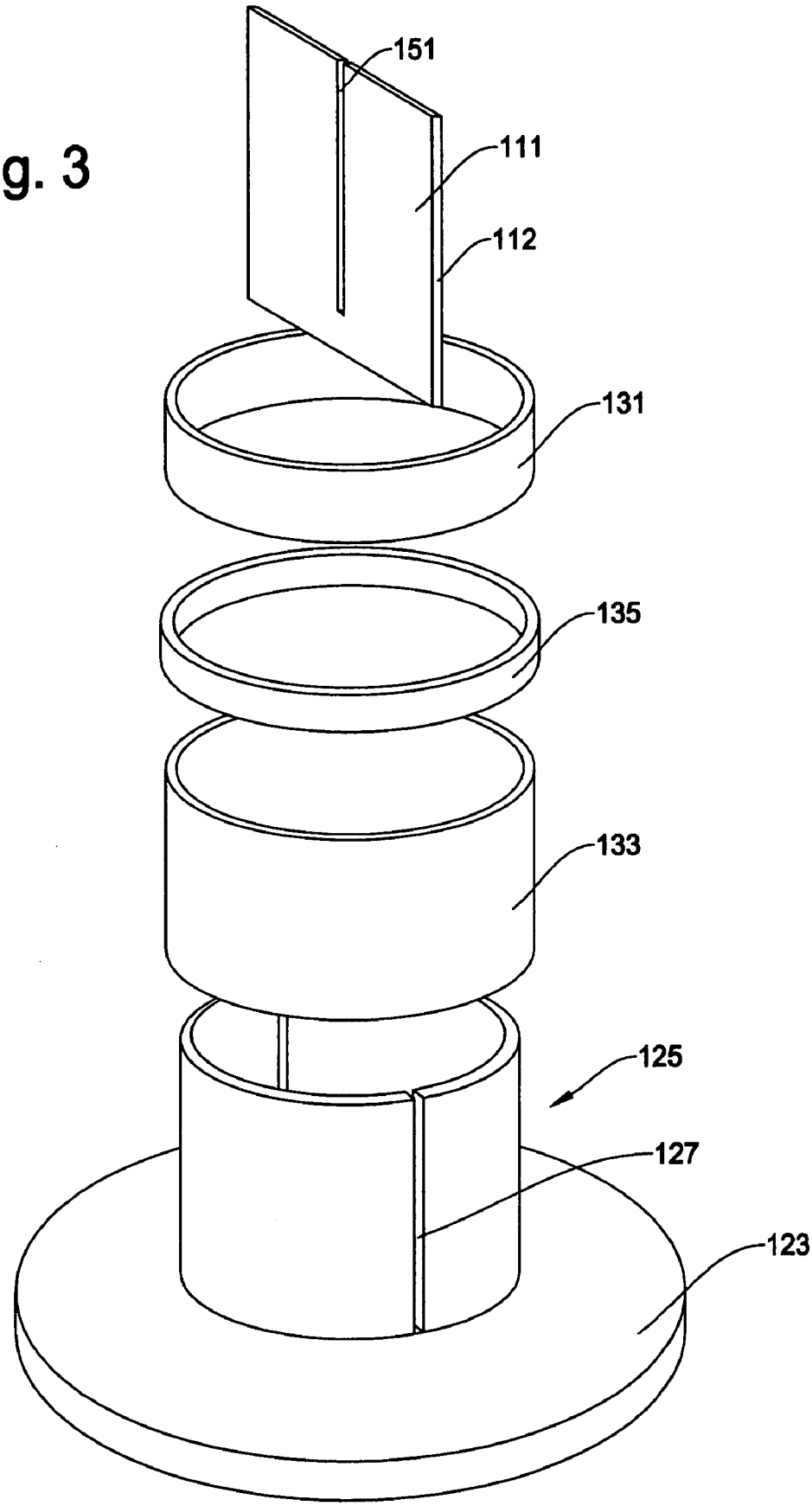
FIG. 3 is an exploded perspective view showing an example of components of the cooling system of FIG. 2 for explaining a shape of each component and a procedure to assemble the components in accordance with the present invention.
Figure 4:
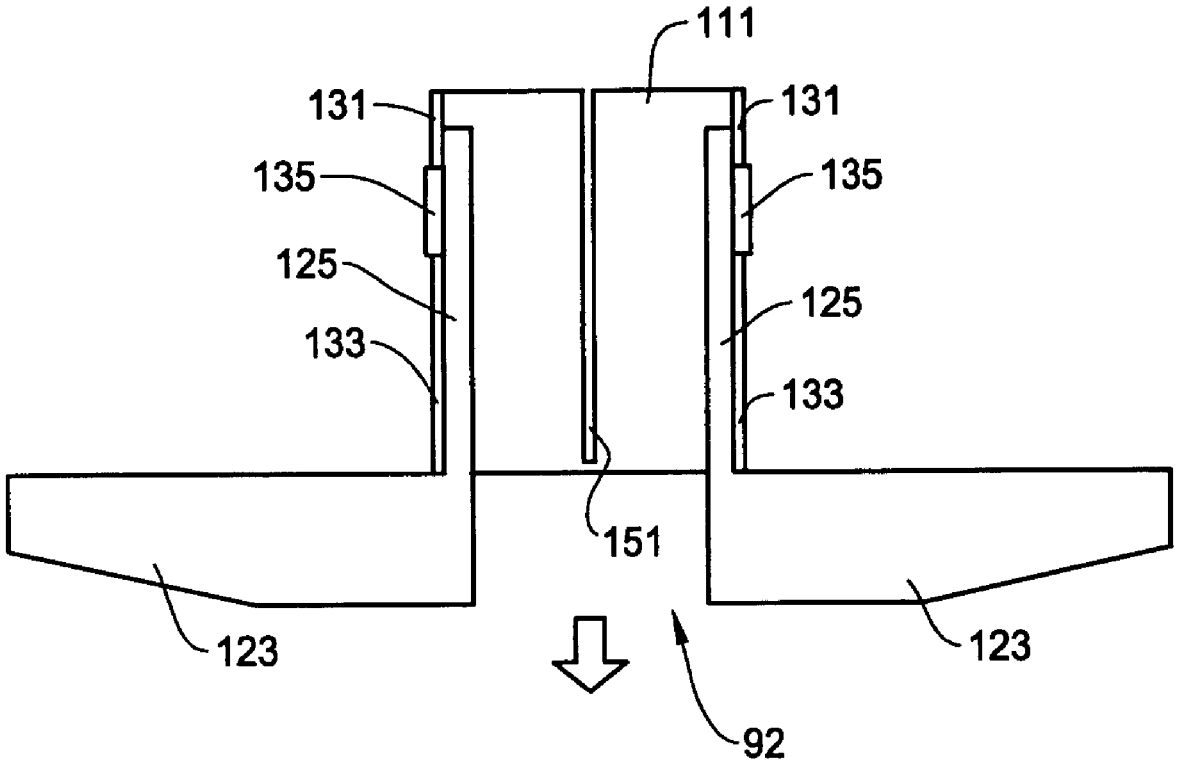
FIG. 4 is a cross sectional view of the cooling system of the present invention in FIGS. 2 and 3 showing the structure of the shorting ring, the heat dissipation plate, and the steel ring.

FIG. 3 is an exploded perspective view showing an example of components of the cooling system of FIG. 2. FIG. 4 is a cross sectional view of the cooling system showing the shorting rings, the heat dissipation plate, and the steel ring after assembled. The exploded view and cross sectional view show the shape of each component forming the cooling system and how the components are assembled in the loudspeaker. In this example, the pole piece 125 is integrally formed with the back plate 123 thereon although it can be made separately from the back plate 123. The pole piece 125 has a pair of slits (insertion cuttings) 127 in which the heat dissipation plate 111 is inserted in a manner that the two side edges of the heat dissipation plate 111 tightly contact with the corresponding slits 127.

When inserted in the slits 127, a surface 112 of the side edge of the heat dissipation plate 111 is flush with the outer surface of the pole piece 125 so that the surface 112 contacts with the inner surfaces of the shorting rings 131 and 133. The heat dissipation plate 111 also thermally ties the upper and lower shorting rings 131 and 133 as well as directly absorbs the radiated heat from the voice coil. As noted above, the voice coil of the loudspeaker generates heat so that the air gap is heated which raises the temperature of the shorting rings 131 and 133. Since the heat dissipation plate 111 physically contacts with the shorting rings 131 and 133, the heat of the shorting rings 131 and 133 is conducted to the heat dissipation plate 111.

The heat of the heat dissipation plate 111 is conducted to the back plate 123 which itself works as a heat sink since it has a large surface area and thermal capacity and is mounted on a frame of the loudspeaker. Thus, a part of the heat from the voice coil is dissipated to the outside through the back plate 123. Another part of the heat from the voice coil conducted to the heat dissipation plate 111 is also transmitted to the outside through the air via an opening 92 at the bottom of the pole piece 125 (FIG. 4).

More specifically, with respect to the heat dissipation through the air, when the loudspeaker is operated, there arises movements of air due to the vibrations of the diaphragm by the reciprocal movements of the voice coil. Thus, the vibration promotes the heated air to exhaust from the opening 92 while intaking the cool air from the outside to the inside of the loudspeaker. This air circulation cools the heat dissipation plate 111, the pole piece 125, the steel ring 135, and the shorting rings 131 and 133, the air gap, and accordingly, the voice coil.

In the assembly process, the heat dissipation plate 111 is press fit to the slits 127 shown in FIG. 3 at the side edges with use of a special tool. An end surface 112 of the side edge of the heat dissipation plate 111 contacts the inner surfaces of the shorting rings 131 and 133 and the steel ring 135. Thus, the heat dissipation plate 111 mechanically contacts with the pole piece 125, the shorting rings 131, 133 and the steel ring 135, i.e., thermally conductive with one another. Thus, the heat generated by the voice coil is transmitted and conducted to the shorting rings 131 and 133, the steel ring 135, and to the heat dissipation plate 111. Since the heat dissipation plate 111 has a large surface area, the heat transferred to the heat dissipation plate 111 is efficiently dissipated to the outside though the opening 92 as shown in the directional arrow at the bottom of the back plate 123 (FIG. 4).

With reference to FIG. 3, the procedure to assemble the cooling system of the present invention is further explained. In this example, the pole piece 125 is integrally formed with the back plate 123 and has the slits (insertion cuttings) 127. The heat dissipation plate 111 is attached to the pole piece 125 by press fit in the slits 127. The width of the heat dissipation plate 111 and the outer diameter of the pole piece 125 are designed to be the same. Further, the inner diameters of the upper and lower shorting rings 131, 133 and the steel ring 135 are designed to precisely match the outer diameter of the pole piece 125. Thus, the maximum contact is achieved among the heat dissipation plate 111, the pole piece 125, the shorting rings 131 and 133, and the steel ring 135.

Since the pole piece 125 is integrally formed with the back plate 123, after or before the heat dissipation plate 111 is mounted, the lower shorting ring 133 is mounted first from the top of the pole piece 125 and assembled at the lower half of the pole piece 125. Then, the steel ring 135 is mounted from the top of the pole piece 125 and assembled at the middle portion of the pole piece 125. Finally, the upper shorting ring 131 is assembled at the upper portion of the pole piece 125. Because of the sizes of the components are so designed as noted above, the heat dissipation plate 111 is tightly attached to the pole piece 125, and the end surface 112 of the side edge of the heat dissipation plate 111 contacts with the inner surfaces of the shorting rings 131, 133 and the steel ring 135. In other words, all of the components in the cooling system are connected with one another for the efficient thermal conduction.

Figure 5:
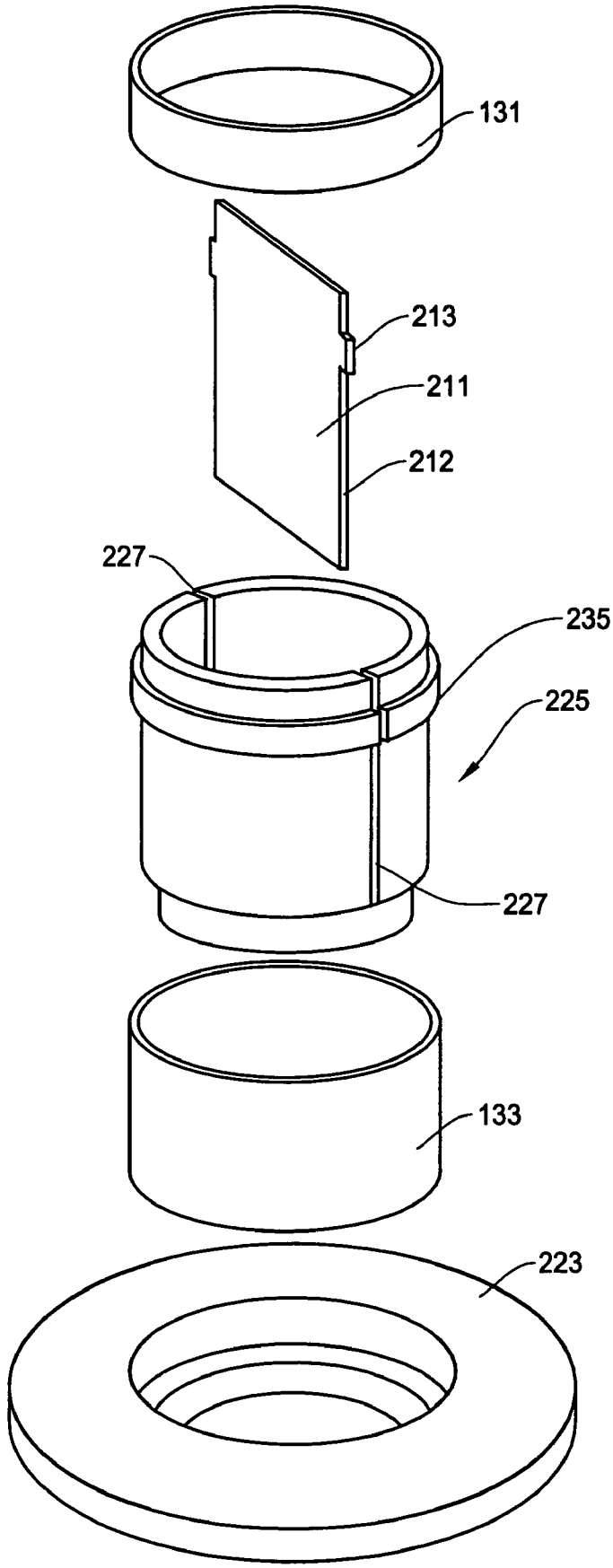
FIG. 5 is an exploded perspective view showing another example of components in the cooling system for explaining a shape of each component and a procedure to assemble the components in accordance with the present invention.
Figure 6:
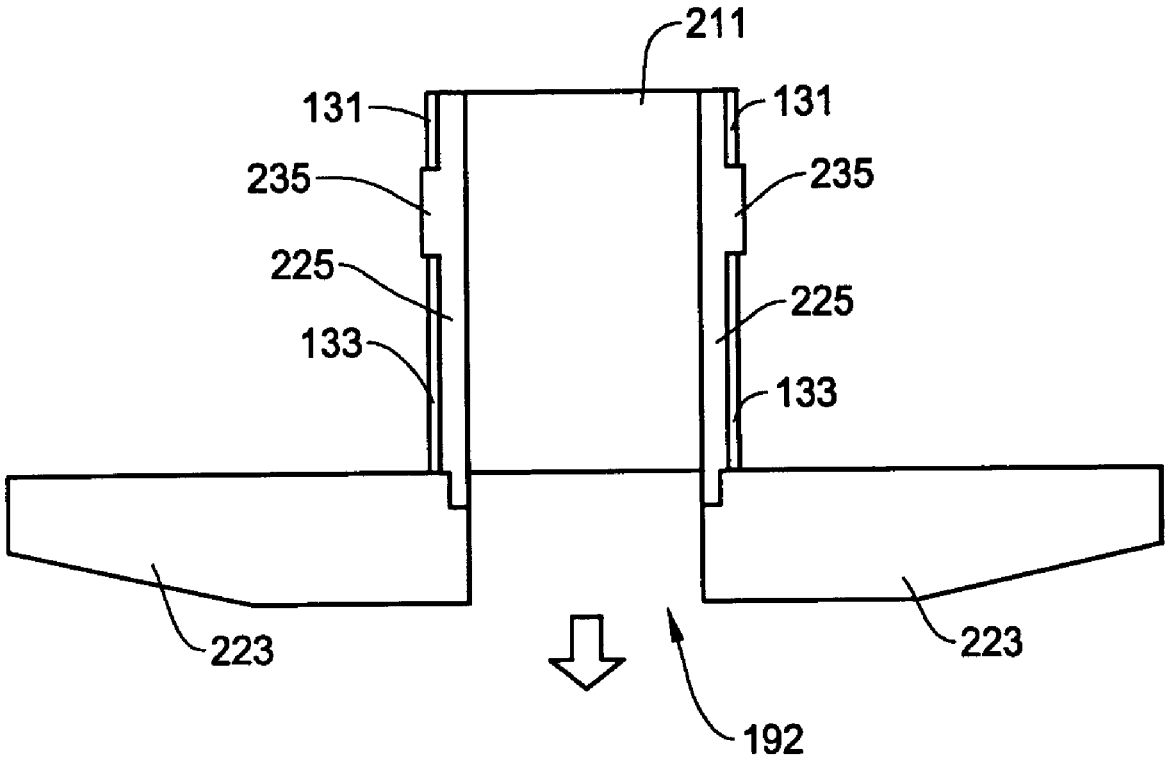
FIG. 6 is a cross sectional view of the cooling system of the present invention shown in FIG. 5 which illustrates the structure of the pole piece, the shorting ring, and the heat dissipation plate.

FIG. 5 is an exploded perspective view showing another example of structure of the cooling system of the present invention. FIG. 6 is a cross sectional view of the cooling system of the present invention of FIG. 5 after assembled. FIGS. 5 and 6 show the shape of each component in the cooling system and how the components are assembled therein. In this example, the pole piece has a magnetic flange which is a projection in the magnetic circuit to form the air gap for the voice coil. Thus, the steel ring 135 in the example of FIGS. 2-4 is not used.

More specifically, in FIGS. 5 and 6, the cooling system is configured by shorting rings 131 and 133, a heat dissipation plate 211, a pole piece 225, and a back plate 223 with an opening 192. As shown in FIG. 5, the pole piece 225 has a magnetic flange 235 integrally formed thereon, and slits (insertion cuttings) 227. The pole piece 225 and the back plate 223 are made of magnetic material while the shorting rings 131, 133 and the heat dissipation plate 211 are made of non-magnetic thermally conductive material such as copper, nickel, aluminum, etc.

The magnetic flange 235 is to form a narrow air gap without using the steel ring 135 shown in FIGS. 2-4 for establishing the magnetic circuit without losing the magnetic flux. The slits 227 receive the heat dissipation plate 211 therein in a manner similar to the above example of FIGS. 2-4. Namely, the width of the slit 227 is designed to match the thickness of the heat dissipation plate 211. Since the magnetic flange 235 is formed integrally on the pole piece 225, for mounting the lower shorting ring 133, the pole piece 225 is separated from the back plate 223.

Unlike the heat dissipation plate 111 of FIGS. 2-4, the heat dissipation plate 211 does not have a central gap or cut. However, it is preferable to have such a cut to maintain the low distortion effect of the shorting rings in the loudspeaker as will be explained later. The heat dissipation plate 211 has projections 213 that match the magnetic flange 235 of the pole piece 225 when inserted in the slits 227. When inserted in the slits 227, the end surfaces 212 of the heat dissipation plate 211 are flush with the outer surface of the pole piece 225. The inner diameter of the upper shorting ring 131 and the lower shorting ring 133 is designed to precisely match the outer diameter of the pole piece 225. Thus, when mounted, the inner surfaces of the shorting rings 131, 133 and the outer surface of the pole piece 225 contact with one another. In this example, since the magnetic flange 235 is integrally formed on the pole piece 225, the lower shorting ring 133 must be attached to the pole piece 225 before the pole piece 225 is mounted on the back plate 223.

Referring now to FIG. 7, there is illustrated a loudspeaker incorporating the cooling system constructed in accordance with the present invention. Although not shown, electrical terminals are provided to the loudspeaker to supply an electrical input signal to a voice coil of the loudspeaker whereby the electrical energy is converted into acoustical energy in the form of sound waves. The loudspeaker of FIG. 7 employs the cooling system of FIGS. 2-4 which utilizes the steel ring.

The loudspeaker of FIG. 7 includes a speaker cone or a diaphragm 54, a coil bobbin 56, and a dust cap 68. The diaphragm 54, the dust cap 68 and the coil bobbin 56 are attached to one another by, for example, an adhesive. Typically, the coil bobbin 56 is made of a high temperature resistant material such as glass fiber or aluminum around which an electrical winding or a voice coil 58 is attached such as by an adhesive. The voice coil 58 is connected to suitable leads (not shown) to receive an electrical input signal through the electrical terminals (not shown).

The diaphragm 54 is provided with an upper half roll 55 at its peripheral made of flexible material such as an urethane foam, butyl rubber and the like. The diaphragm 54 is connected to the speaker frame 52 at the upper half roll 55 by means of, for example, an adhesive. The speaker frame 52 has a plurality of radially and downwardly extending frame members 57 and is integrally constructed of a stiff antivibrational material, such as aluminum.

At about the middle of the speaker frame 52, the intersection of the diaphragm 54 and the coil bobbin 56 is connected to the speaker frame 52 through a spider (inner suspension) 61 made of a flexible material such as cotton with phenolic resin and the like. The upper half roll 55 and the spider 61 allow the flexible vertical movements of the diaphragm 54 as well as limit the amplitudes (movable distance in an axial direction) of the diaphragm 54 when it is vibrated in response to the electrical input signal.

The loudspeaker also comprises a magnetic assembly (magnetic circuit) including an air gap 72, an upper plate 66, a permanent magnet 62, and the pole piece 125. The cooling system is formed with the pole piece 125, the upper and lower shorting rings 131, 133, the steel ring 135, and the heat dissipation plate 111. The back plate 123 is provided at the inner bottom of the speaker frame 52. The pole piece 125, the permanent magnet 62 and the upper plate 66 are positioned axially inward from the speaker frame 52. The pole piece 125 (back plate 123) has a central opening (air passage) 92 in the axial direction.

The permanent magnet 62 is disposed between the upper plate 66 and the back plate 123. The upper plate 66, the pole piece 125, and the back plate 123 are made of magnetic material capable of carrying magnetic flux, such as steel. Therefore, a magnetic circuit is created through the pole piece 125, the steel ring 135, the air gap 72, the upper plate 66, the permanent magnet 62, and the back plate 123 through which the magnetic flux generated by the permanent magnet 62 runs.

The voice coil 58 and the coil bobbin 56 are inserted in the air gap 72 created between the steel ring 135 and the upper plate 66 in the manner shown in FIG. 7. Thus, when the electrical input signal is applied to the voice coil 58, the current flowing in the voice coil 58 and the magnetic flux (flux density) in the air gap 72 interact with one another. This interaction produces a force on the voice coil 58 which is proportional to the product of the current and the flux density. This force activates the reciprocal movement of the voice coil 58, which vibrates the diaphragm 54, thereby producing the sound waves.

The upper shorting ring 131 and lower shorting ring 133 are provided to stabilize the magnetic field against changes caused by the current in the voice coil 58. The heat generated by the voice coil 58 is transmitted to the upper shorting ring 131, steel ring 135, and lower shorting ring 133. The heat is further conducted to the pole piece 125 and the heat dissipation plate 111. The heat transferred to the heat dissipation plate 111 is dissipated through the opening 92 to the outside by the movements of the air caused by the vibration of the diaphragm 54. Conversely, the cool air from the outside through the opening 92 cools down the heat dissipation plate 111, the pole piece 125, shorting rings 131, 133, steel ring 135, and the voice coil 58.

Figure 8:
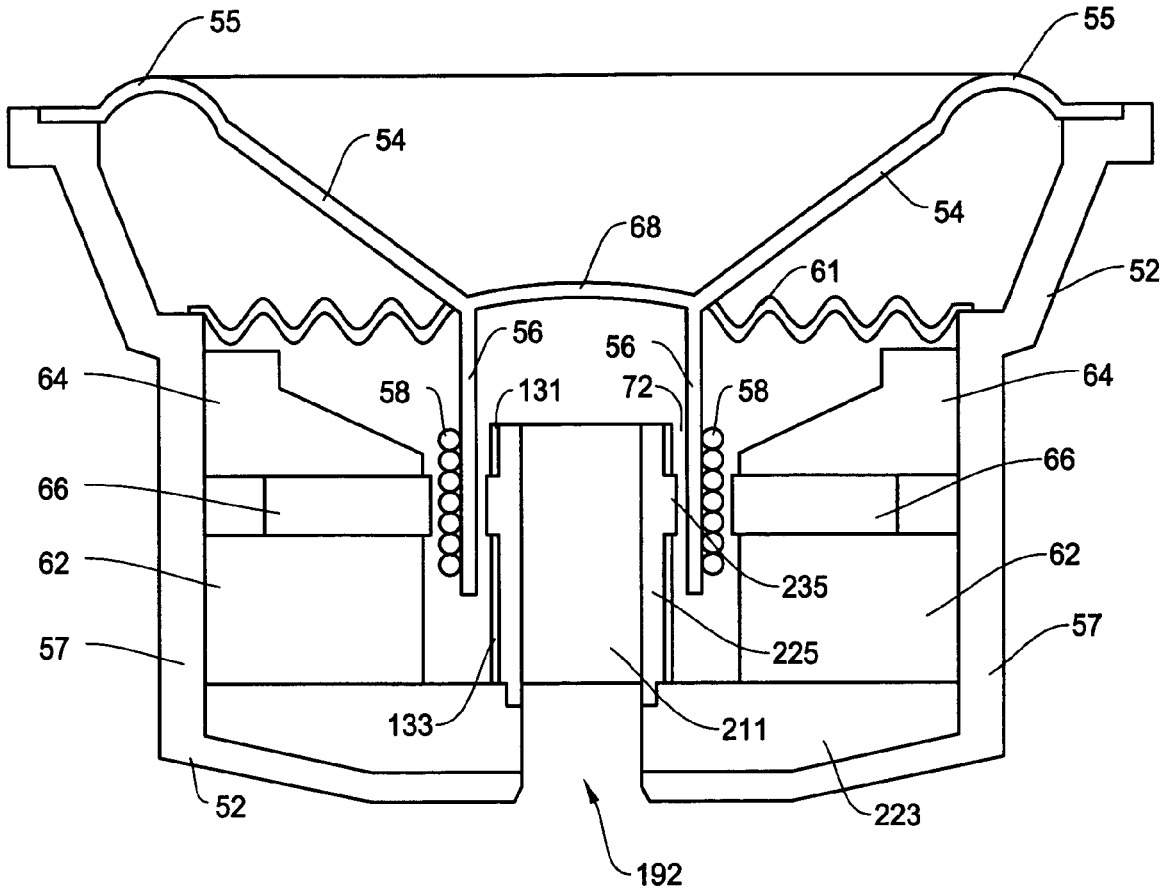
FIG. 8 is a cross sectional view showing another example of inner structure of the loudspeaker of the present invention incorporating the cooling system of FIGS. 5-6 and a heat transfer plate with radial cooling fins.

FIG. 8 is a cross sectional view showing another example of loudspeaker incorporating the cooling system of the present invention. The inventor of the present invention has proposed a loudspeaker with a heat transfer plate having a plurality of cooling fins in U.S. Pat. No. 6,678,387 which is incorporated by reference. The cooling fins are provided on the upper plate and are radially outwardly extending toward an outer rim thereof and inner and outer air openings are formed on the outer rim. In the example of FIG. 8, the cooling system shown in FIGS. 5 and 6 is incorporated in the loudspeaker having the radial cooling fins disclosed in the patent noted above.

The structure of the loudspeaker shown in FIG. 8 is the same as that shown in FIG. 7 except that a heat transfer plate 64 having cooling fins is placed on the upper plate 66 to dissipate the heat efficiently and the cooling system of FIGS. 5 and 6 is used. The heat transfer plate 64 efficiently dissipates the heat generated by the voice coil 58 to the outside through the side openings (not shown) of the loudspeaker. At the same time, the heat transfer plate 64 efficiently intakes the cool air from the outside to cool down the voice coil 58.

Figure 15:
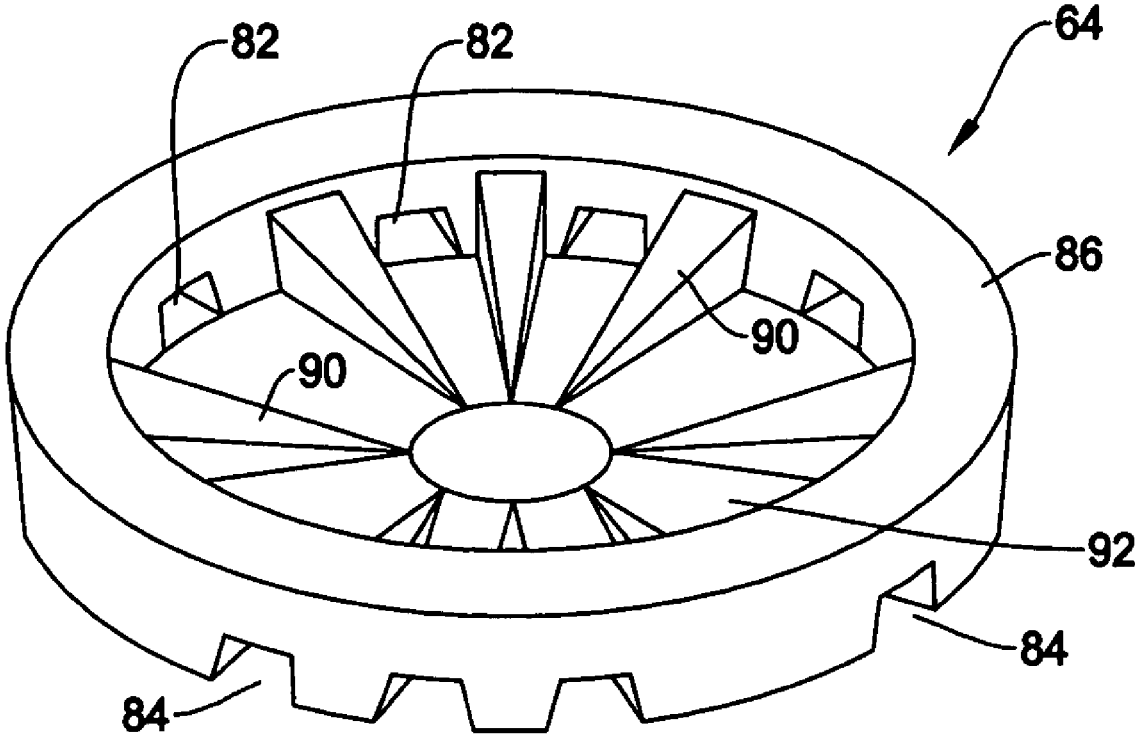
FIG. 15 is a perspective view showing an example of structure of the heat transfer plate incorporated in the loudspeaker of FIG. 8.

FIG. 15 is a perspective view showing an example of structure of the heat transfer plate 64. The heat transfer plate 64 has a plurality of cooling fins 90 radially outwardly extending toward an outer rim 86. The height and thickness of the cooling fins 90 increase toward the outer rim 86. The heat transfer plate 64 has a floor 92 between two adjacent cooling fins 90 which is slightly inclined toward the outer rim 86. Under the outer rim 86, the heat transfer plate 64 has an inner air opening 82 and an outer air opening 84 at each end of the floor 92. More detailed disclosure of the structure and effects of the heat transfer plate is given in U.S. Pat. No. 6,678,387.

The pole piece 225 has the magnetic flange 235 for creating the narrow air gap of the magnetic path. The shorting rings 131 and 133 are mounted on the pole piece 225 which is attached to the back plate 223. As seen from FIG. 8, the cooling system including the heat dissipation plate 211 is provided at an inner area of the loudspeaker relative to the voice coil 58. Conversely, the heat transfer plate 64 is provided at an outer area of the loudspeaker relative to the voice coil 58. Since the voice coil 58 is cooled at the both sides by the heat transfer plate 64 and the heat dissipation plate 211, the heat dissipation effect is maximized in the loudspeaker.

Figure 9:
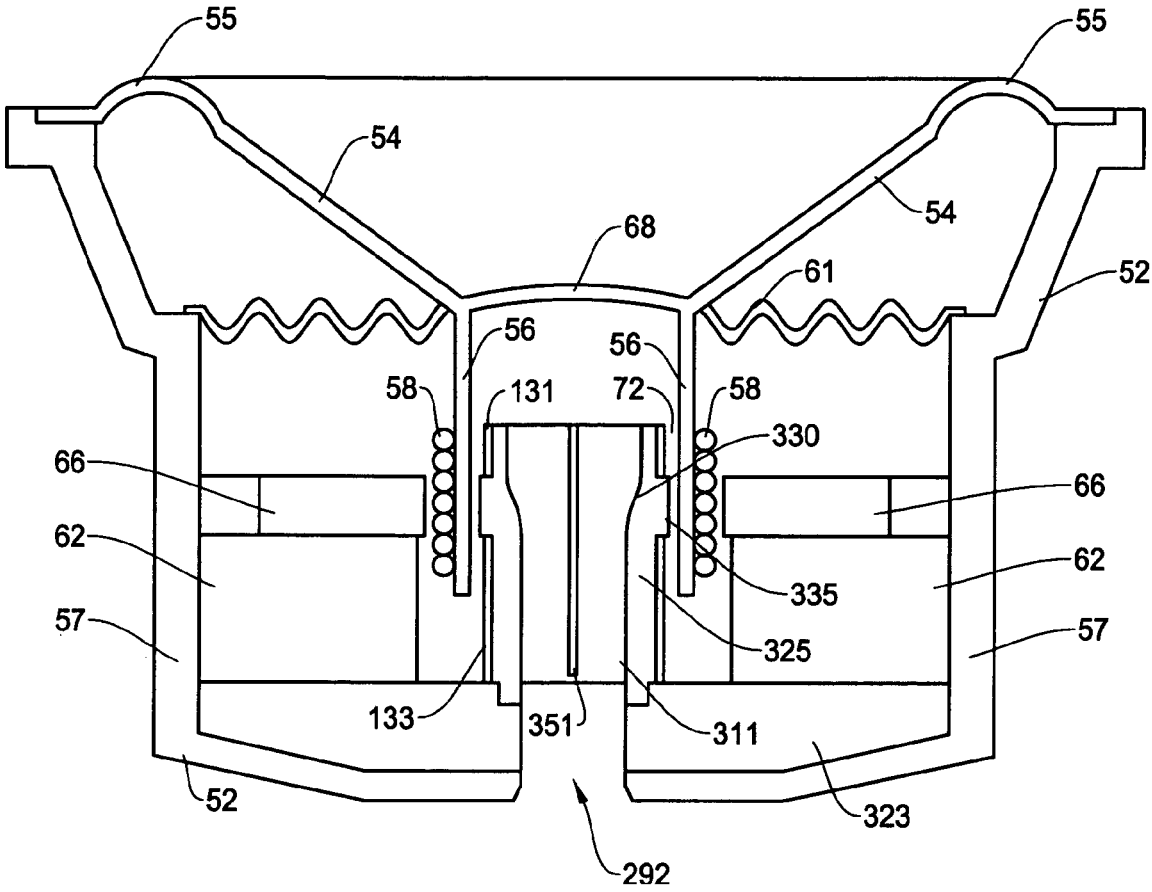
FIG. 9 is a cross sectional view showing a further example of inner structure of the loudspeaker incorporating the cooling system of the present invention which utilizes the pole piece having a compound radius curve on the inner surface in cross section.

FIG. 9 is a cross sectional view showing another example of loudspeaker incorporating the cooling system of the present invention. The inventor of the present invention has proposed a loudspeaker with a pole piece of unique shape for achieving low audio distortion in U.S. Pat. No. 6,639,993 which is incorporated by reference. In the proposed technology, a through hole (inner opening) of a pole piece is curved with an S-shape (compound radius curve) in cross section and an inner diameter of the though hole is increased toward the inner top so that magnetic flux is uniformly distributed to ameliorate the distortion. The cooling system having the shorting rings and heat dissipation plate of the present invention is used in the loudspeaker in combination with the pole piece of compound radius curve noted above.

The structure of the loudspeaker shown in FIG. 9 is the same as that shown in FIG. 8 except that the inner side of a pole piece 325 is curved in S-shape (compound radius) as indicated by numeral 330 to improve acoustic performance of the loudspeaker. The pole piece 325 has a magnetic flange 335 for creating the narrow air gap of the magnetic circuit. The shorting rings 131 and 133 are mounted on the pole piece 325 which is mounted on the back plate 323 where an opening 292 is provided thereto. As seen from FIG. 9, the heat dissipation plate 311 has a gap 351 at about the center thereof to minimize the adverse affect to the shorting rings 131 and 133. The heat generated in the loudspeaker is dissipated through the shorting rings 131 and 133 and the heat dissipation plate 311 in the same manner described in the foregoing.

Figure 10A:
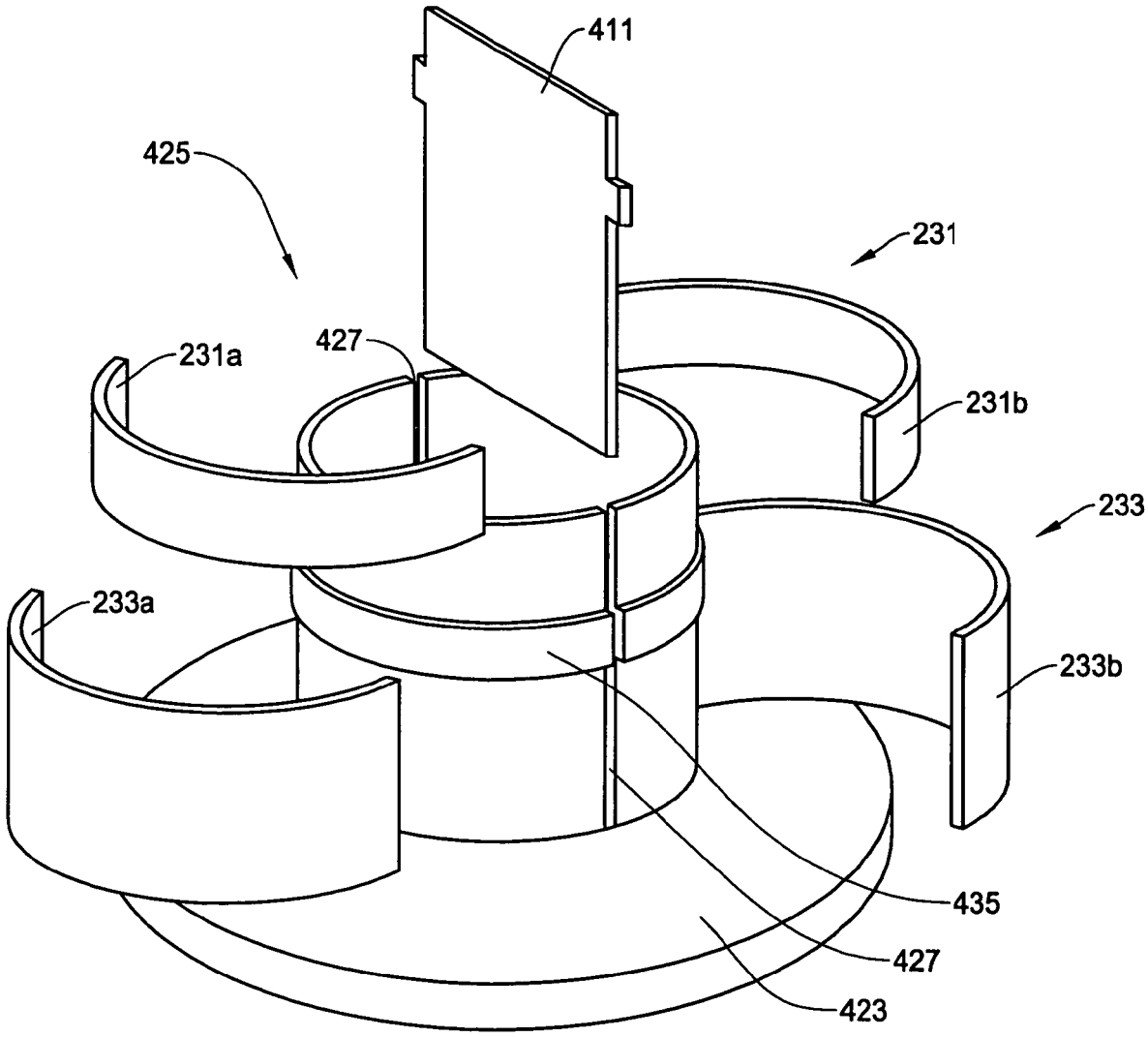
FIG. 10A is an exploded perspective view showing a further example of components of the cooling system of the present invention in which each shorting ring is configured by two semicircular members.
Figure 10B:
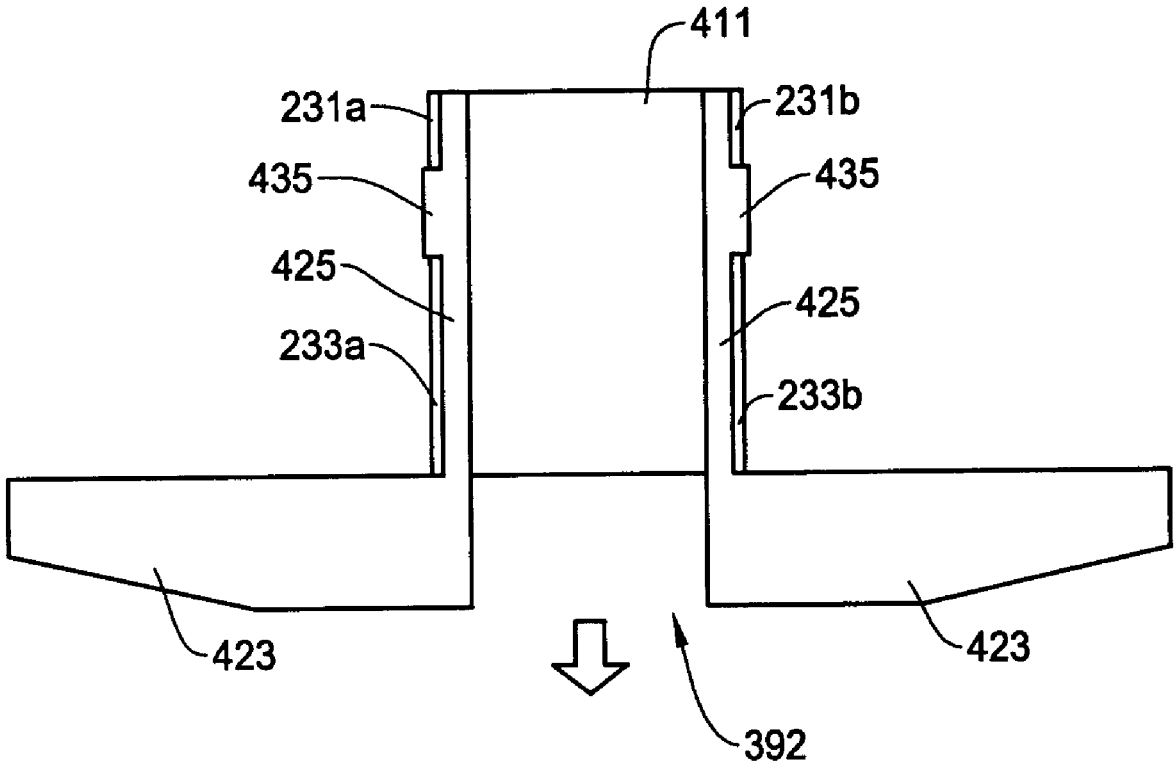
FIG. 10B is a cross sectional view of the cooling system of FIG. 10A.

FIG. 10A is a perspective view showing a further example of structure of the cooling system of the present invention. FIG. 10B is a cross sectional view of the cooling system of FIG. 10A when assembled. In this example, a pole piece 425 is integrally formed with a back plate 423 and has a magnetic flange 435. Each shorting ring is configured by two semicircular members to be easily mounted on the pole piece 425 from the side. Namely, an upper shorting ring 231 is configured by semicircular members 231*a* and 231*b* and a lower shorting ring 233 is configured by semicircular members 233*a* and 233*b*. When assembling the cooling system, the semicircular members 231*a*, 231*b* and 233*a*, 233*b* are mounted on the outer surface of the pole piece 425 in a manner to wrap around the pole piece 425. The upper shorting ring 231 can be a single ring rather than two semicircular members because it can be easily mounted on the pole piece 425 from the top.

Then, preferably, the semicircular members 231*a* and 231*b* are soldered to form the upper shorting ring 231, and the semicircular members 233*a* and 233*b* are soldered to form the lower shorting ring 233. The pole piece 425 is provided with insertion cuttings (slits) 427. Similar to the foregoing examples, the heat dissipation plate 411 is inserted in the slits 427 on the pole piece 425. The end surfaces of the side edges of the heat dissipation plate 411 contact the inner surfaces of the upper shorting ring 231 and the lower shorting ring 233, thereby allowing the heat generated by the voice coil 58 to be transmitted to the shorting rings 231, 233 and to the heat dissipation plate 411. The heat from the heat dissipation plate 411 is dissipated to the outside through an opening 392 (FIG. 10B) of the pole piece 425.

Figure 11:
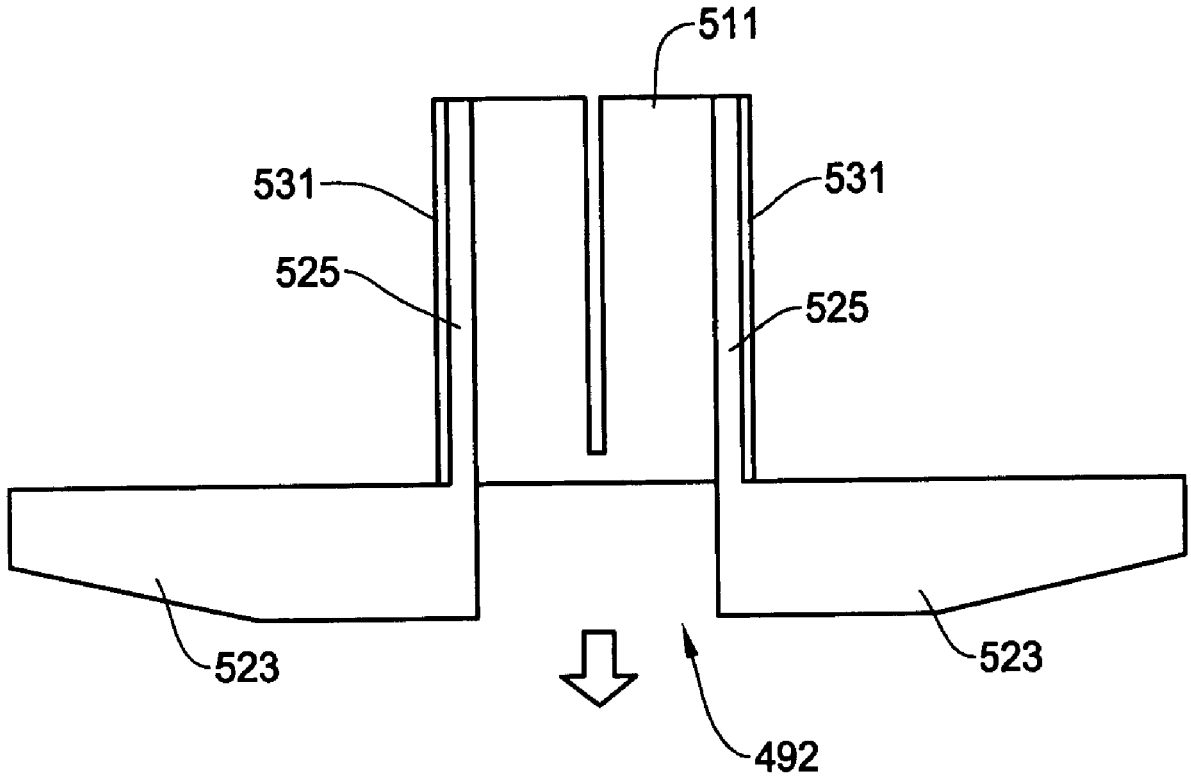
FIG. 11 is a cross sectional view showing a further example of the cooling system of the present invention without incorporating the steel ring or the magnetic flange on the pole piece for the magnetic path.

FIG. 11 is a cross sectional view showing a further example of structure of the cooling system of the present invention. In this example, the cooling system is formed without using a magnetic flange integral with the pole piece or a steel ring mounted on the pole piece. Thus, a pole piece 525 does not have any projection for the air gap and a single shorting ring 531 is mounted on the pole piece 525. The cooling system in this example has a simple structure for achieving low cost and easy assembly although the audio performance level may be lower than the foregoing examples because the air gap in the magnetic path cannot be small enough which may suffer from loss of magnetic flux.

A heat dissipation plate 511 is inserted in slits on the pole piece 525 in a manner to contact with the inner surface of the shorting ring 531. Thus, the heat generated by the voice coil in the loudspeaker is transmitted to the shorting ring 531 and to the heat dissipation plate 511. The heat from the heat dissipation plate 511 is dissipated to the outside through an opening 492 of the pole piece 525 and the back plate 523. The cool air from the outside is introduced through the opening 492 to cool the heat dissipation plate 511, the pole piece 525, the shorting ring 531, and the voice coil.

Figure 12A:
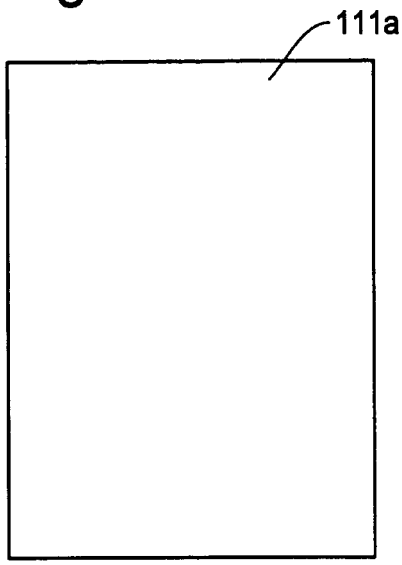
FIG. 12A is a front view showing an example of heat dissipation plate without a central cut used in the cooling system of the present invention.
Figure 12B:
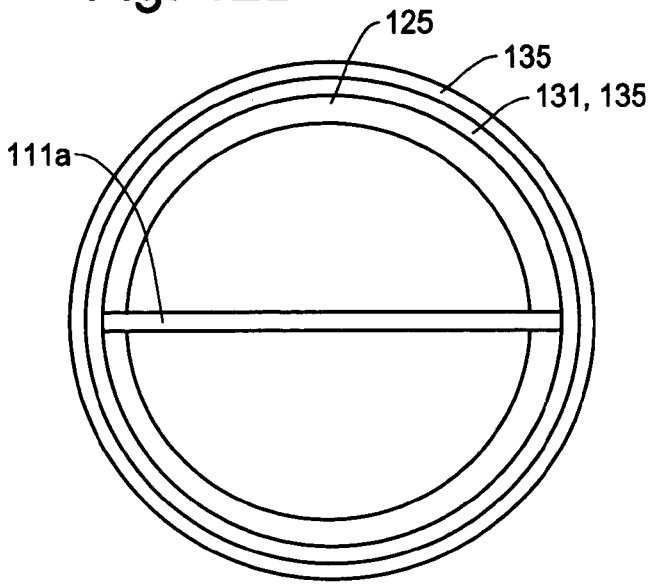
FIG. 12B is a top view showing the cooling system using the heat dissipation plate of FIG. 12A.
Figure 13A:
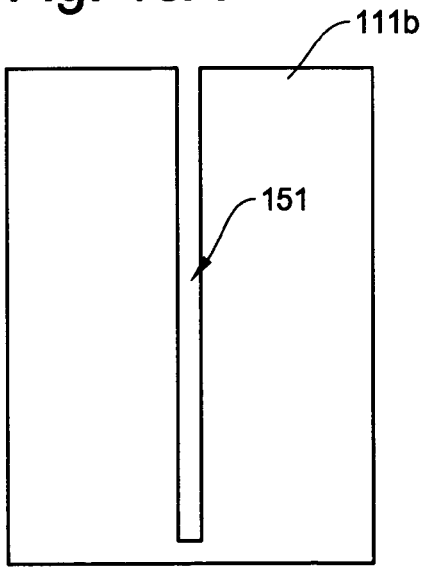
FIG. 13A is a front view showing an example of heat dissipation plate having a central cut used in the cooling system of the present invention.
Figure 13B:
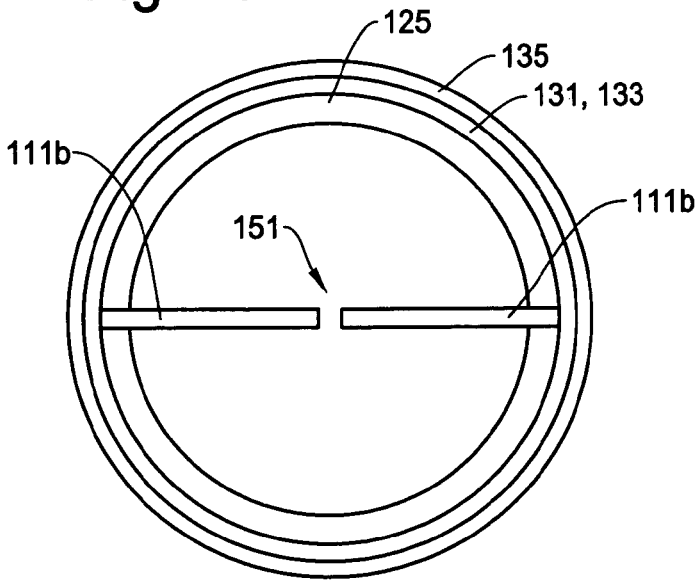
FIG. 13B is a top view showing the cooling system using the heat dissipation plate of FIG. 13A.

FIG. 12A is a front top view showing the heat dissipation plate 111*a* used in the cooling system of the present invention. The heat dissipation plate 111*a* does not have the central cut (gap) 151. FIG. 12B is a plan view of the cooling system incorporating the heat dissipation plate 111*a* of FIG. 12A. FIG. 13A is a front top view showing the heat dissipation plate 111*b* used in the cooling system of the present invention. The heat dissipation plate 111*b* has the central cut (gap) 151. FIG. 13B is a plan view of the cooling system incorporating the heat dissipation plate 111*b* of FIG. 13A.

Figure 14A:
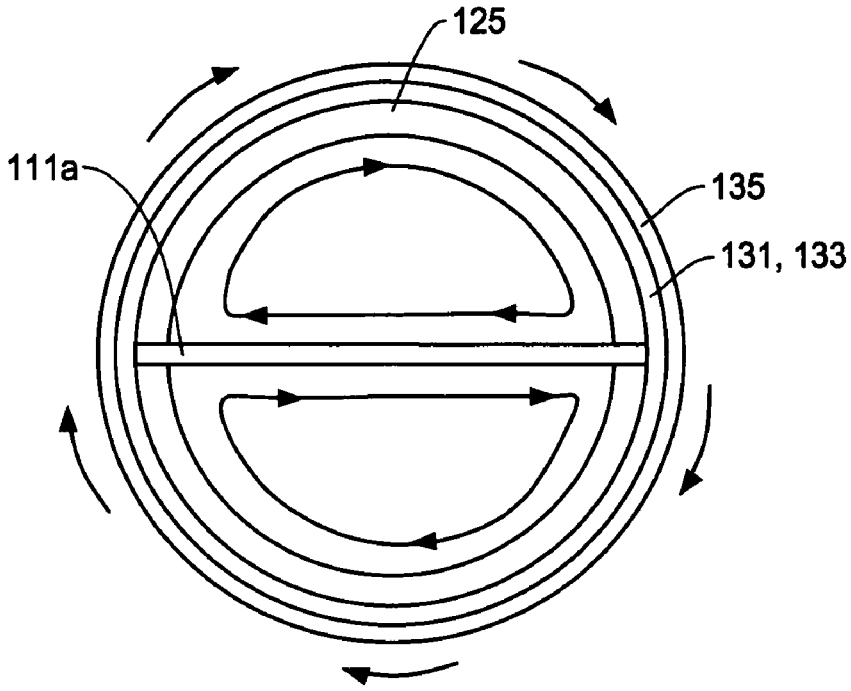
FIG. 14A is a schematic diagram showing an example of electric current flow involved in the heat dissipation plate without the central cut.

FIG. 14A is a plan view corresponding to FIG. 12B which schematically shows flows of electric current involved in the shorting rings 131, 133 and the heat dissipation plate 111*a*. Without the gap 151, as shown by the arrows in FIG. 14A, electric current flows through the shorting rings 131, 133 and the heat dissipation plate 111*a* because they are made of electric conductive material. Thus, the electric current flowing through the heat dissipation plate 111*a* disturbs the performance of the shorting rings 131, 133 in suppressing the impedance modulation.

Figure 14B:
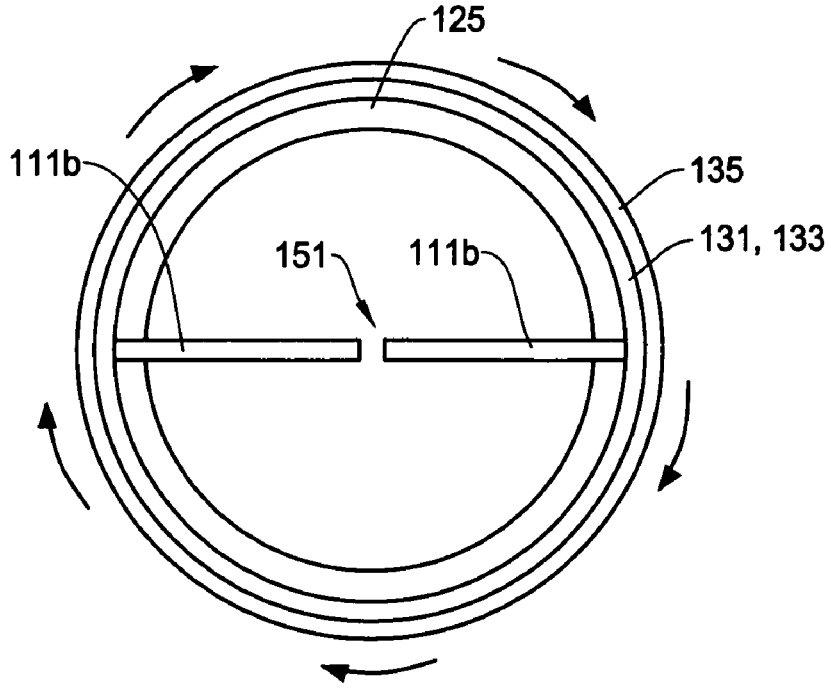
FIG. 14B is a schematic diagram showing an example of electric current flow involved in the heat dissipation plate with the central cut.

FIG. 14B is a plan view corresponding to FIG. 13B which schematically shows electric current flows involved in the shorting rings 131, 133 and the heat dissipation plate 111*b*. Since the gap 151 is formed on the heat dissipation plate, as shown by the arrows in FIG. 14B, electric current is not able to flow through the heat dissipation plate 111*b*. Thus, the electric current flowing through the shorting rings 131, 133 for suppressing the impedance modulation is not disturbed by the heat dissipation plate. Therefore, the central cut (gap) 151 is effective in maintaining the effect of the shorting rings in the loudspeaker.

As described in the foregoing, in the loudspeaker of the present invention, the cooling system can efficiently dissipate the heat through the shorting rings and the heat dissipation plate. The loudspeaker utilizing the cooling system of the present invention achieves a significant increase in the cooling efficiency while maintaining the low distortion effect based on the shorting rings. The cooling system of the present invention has a simple structure which is relatively easy to assemble, thereby decreasing the overall cost and production time of the loudspeaker.

Although only a preferred embodiment is specifically illustrated and described herein, it will be appreciated that many modifications and variations of the present invention are possible in light of the above teachings and within the purview of the appended claims without departing the spirit and intended scope of the invention.

What is claimed is:

1. A loudspeaker, comprising:

a speaker frame;

a diaphragm connected to the speaker frame in a manner capable of vibration;

a voice coil connected to the diaphragm for vibrating the diaphragm;

a magnetic assembly including a permanent magnet for creating a magnetic circuit for interaction with the voice coil;

a pole piece disposed at a central opening of the magnetic assembly to form an air gap in the magnetic circuit with the magnetic assembly into which the voice coil is movably provided;

a shorting ring mounted on an outer surface of the pole piece; and a heat dissipation plate mounted on the pole piece at an inner opening thereof and connected to the shorting ring;

wherein the heat dissipation plate and the shorting ring are made of non-magnetic and thermally conductive material, and wherein an inner surface of the shorting ring and the outer surface of the pole piece contact with one another.

2. A loudspeaker as defined in claim 1, further comprising a back plate forming a part of the magnetic circuit on which the pole piece is mounted.

3. A loudspeaker as defined in claim 2, wherein the back plate and the pole piece are integrally formed with one another by magnetic material.

4. A loudspeaker as defined in claim 2, wherein the back plate and the pole piece are separately formed from one another by magnetic material and attached to one another.

5. A loudspeaker as defined in claim 2, further comprising a steel ring mounted on the outer surface of the pole piece for forming the air gap in the magnetic circuit, and wherein the shorting ring is comprised of an upper shorting ring and a lower shorting ring where the steel ring is positioned between the upper shorting ring and the lower shorting ring on the pole piece, and wherein the back plate and the pole piece are integrally formed with one another by magnetic material.

6. A loudspeaker as defined in claim 2, wherein the pole piece has a magnetic flange projected from the outer surface thereof for the air gap in the magnetic circuit, and wherein the shorting ring is comprised of an upper shorting ring and a lower shorting ring where the upper shorting ring is positioned over the magnetic flange and the lower shorting ring is positioned under the magnetic flange, and wherein the back plate and the pole piece are separately formed from one another by magnetic material and attached to one another.

7. A loudspeaker as defined in claim 1, further comprising a steel ring mounted on the outer surface of the pole piece for forming the air gap in the magnetic circuit, and wherein the shorting ring is comprised of an upper shorting ring and a lower shorting ring where the steel ring is positioned between the upper shorting ring and the lower shorting ring on the pole piece.

8. A loudspeaker as defined in claim 1, wherein the pole piece has an integral magnetic flange projected from the outer surface thereof for the air gap in the magnetic circuit, and wherein the shorting ring is comprised of an upper shorting ring and a lower shorting ring where the upper shorting ring is positioned over the magnetic flange and the lower shorting ring is positioned under the magnetic flange.

9. A loudspeaker as defined in claim 1, wherein the heat dissipation plate has a cut at about a center thereof in an axial direction of the loudspeaker for preventing an electric current in the shorting ring from flowing through the heat dissipation plate.

10. A loudspeaker as defined in claim 1, further comprising a heat transfer plate formed over the magnetic assembly for transferring heat between inside and outside of the loudspeaker.

11. A loudspeaker as defined in claim 10, the heat transfer plate is comprised of a plurality of cooling fins radially outwardly extending toward an outer rim where height and thickness of the cooling fins increase toward the outer rim, a floor between two adjacent cooling fins, and air openings under the outer rim at an end of the floor.

12. A loudspeaker as defined in claim 1, wherein a top area of the central opening of the pole piece is curved in an S-shape in cross section and an inner diameter of the central opening is increased toward the top thereof.

13. A loudspeaker as defined in claim 1, wherein the shorting ring is configured by two semicircular members which are connected to one another after being mounted on the outer surface of the pole piece.

14. A loudspeaker as defined in claim 1, wherein the shorting ring is comprised of an upper shorting ring and a lower shorting ring where the steel ring is positioned between the upper shorting ring and the lower shorting ring on the pole piece, wherein at least the lower shorting ring is configured by two semicircular members which are connected to one another after being mounted on the outer surface of the pole piece.

15. A method of assembling the cooling system in a loudspeaker, comprising the following steps of:

mounting a lower shorting ring on a pole piece;

mounting a steel ring made of magnetic material on the pole piece right above the lower shorting ring;

inserting a heat dissipation plate in slits of the pole piece;

mounting an upper shorting ring on the pole piece right above the steel ring; and mounting the pole piece at a bottom center of a frame of the loudspeaker;

wherein the heat dissipation plate is connected to the upper and lower shorting rings, and wherein the heat dissipation plate and the shorting ring are made of non-magnetic and thermally conductive material, and wherein inner surfaces of the upper and lower shorting rings and an outer surface of the pole piece contact with one another.

16. A method of assembling the cooling system as defined in claim 15, wherein the steps of inserting the heat dissipation plate and mounting the shorting rings include a step of connecting the shorting rings and the heat dissipation plate with one another.

17. A method of assembling the cooling system as defined in claim 15, wherein the shorting ring is configured by two semicircular members, and the step of mounting the shorting ring includes a step of connecting the two semicircular members to one another after mounting on the pole piece.

18. A method of assembling the cooling system in a loudspeaker, comprising the following steps of:

mounting a lower shorting ring on a pole piece, the pole piece having a magnetic flange integrally formed thereon and projected from an outer surface of the pole piece;

mounting the pole piece on a back plate;

inserting a heat dissipation plate in slits of the pole piece;

mounting an upper shorting ring on the pole piece right above the magnetic flange; and mounting the pole piece and the back plate at a bottom center of a frame of the loudspeaker;

wherein the heat dissipation plate is connected to the upper and lower shorting rings, and wherein the heat dissipation plate and the shorting ring are made of non-magnetic and thermally conductive material, and wherein inner surfaces of the upper and lower shorting rings and an outer surface of the pole piece contact with one another.

19. A method of assembling the cooling system as defined in claim 18, wherein the steps of inserting the heat dissipation plate and mounting the shorting rings include a step of connecting the shorting rings and the heat dissipation plate with one another.

* * * * *